US006212839B1

(12) United States Patent
Carlberg

(10) Patent No.: US 6,212,839 B1
(45) **Date of Patent: *Apr. 10, 2001**

(54) DESIGN ELEMENT FOR BUILDING STRUCTURES

(75) Inventor: Gustaf Carlberg, Kungsbacka (SE)

(73) Assignee: Macgregor (SWE) AB (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/836,251

(22) PCT Filed: Nov. 3, 1995

(86) PCT No.: PCT/SE95/01299

§ 371 Date: Jul. 15, 1997

§ 102(e) Date: Jul. 15, 1997

(87) PCT Pub. No.: WO96/14235

PCT Pub. Date: May 17, 1996

(30) Foreign Application Priority Data

Nov. 3, 1994 (SE) ..... 9403764

(51) Int. Cl.[7] ..... E04C 2/34

(52) U.S. Cl. ..... 52/483.1; 52/481.1; 52/799.11; 52/801.11

(58) Field of Search ..... 52/53, 480, 781, 52/797.1, 799.11, 801.1, 801.11, 435, 762, 770, 772, 481.1, 483.1, 481.2

(56) References Cited

U.S. PATENT DOCUMENTS

| | | | | |
|---|---|---|---|---|
| 384,421 | * | 6/1888 | Brown | 52/480 X |
| 2,832,300 | * | 4/1958 | Jacobson | 52/510 X |
| 3,067,843 | * | 12/1962 | Rushtoh et al. | 52/801.11 X |
| 3,178,026 | * | 4/1965 | Christy | 52/396.04 X |
| 3,302,361 | * | 2/1967 | Oudheusden, Jr. et al. | 52/801.11 X |
| 3,872,639 | * | 3/1975 | Crumbaugh et al. | 52/506.03 X |
| 3,884,646 | | 5/1975 | Kenney . | |
| 3,940,899 | * | 3/1976 | Balinski | 52/481.1 |
| 4,860,508 | * | 8/1989 | Jackson et al. | 52/480 X |

FOREIGN PATENT DOCUMENTS

| | | |
|---|---|---|
| 36 36 653 A1 | 5/1988 | (DE) . |
| 0 074 732 | 3/1983 | (EP) . |
| 0 267 167 | 5/1988 | (EP) . |
| 156683 | 7/1987 | (NO) . |

OTHER PUBLICATIONS

Derwent's abstract, No. K9507 E/33, week 8233, Abstract of SU, 872373 (Ivlev, A.P.) Oct. 15, 1981.

* cited by examiner

*Primary Examiner*—Richard Chilcot
(74) *Attorney, Agent, or Firm*—Lerner, David, Littenberg, Krumholz & Mentlik, LLP

(57) ABSTRACT

The invention relates to a structural element for ships' decks, ships' bulkheads, ships' loading ramps, shore-mounted loading ramps, ships' elevators, ships' doors, loading hatches or the like. The element comprises a frame structure and at least one support plane. The invention is particularly characterized by said support plane being constituted by a plurality of plate-like sandwich elements which are connected with said frame structure in such a way that they integrally contribute to the overall strength of the structural element. Said sandwich elements serve as flanges for beams with conventional webs which are included in the structural element. In a preferred embodiment of the invention, the sandwich element comprises a core consisting of a pyramidal framework structure, said core being positioned between two covering plates.

12 Claims, 3 Drawing Sheets

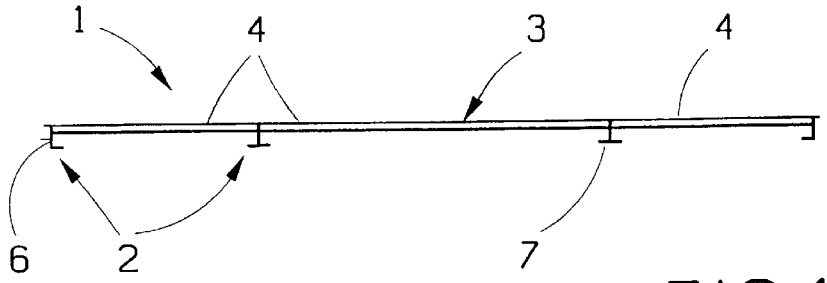
FIG.1
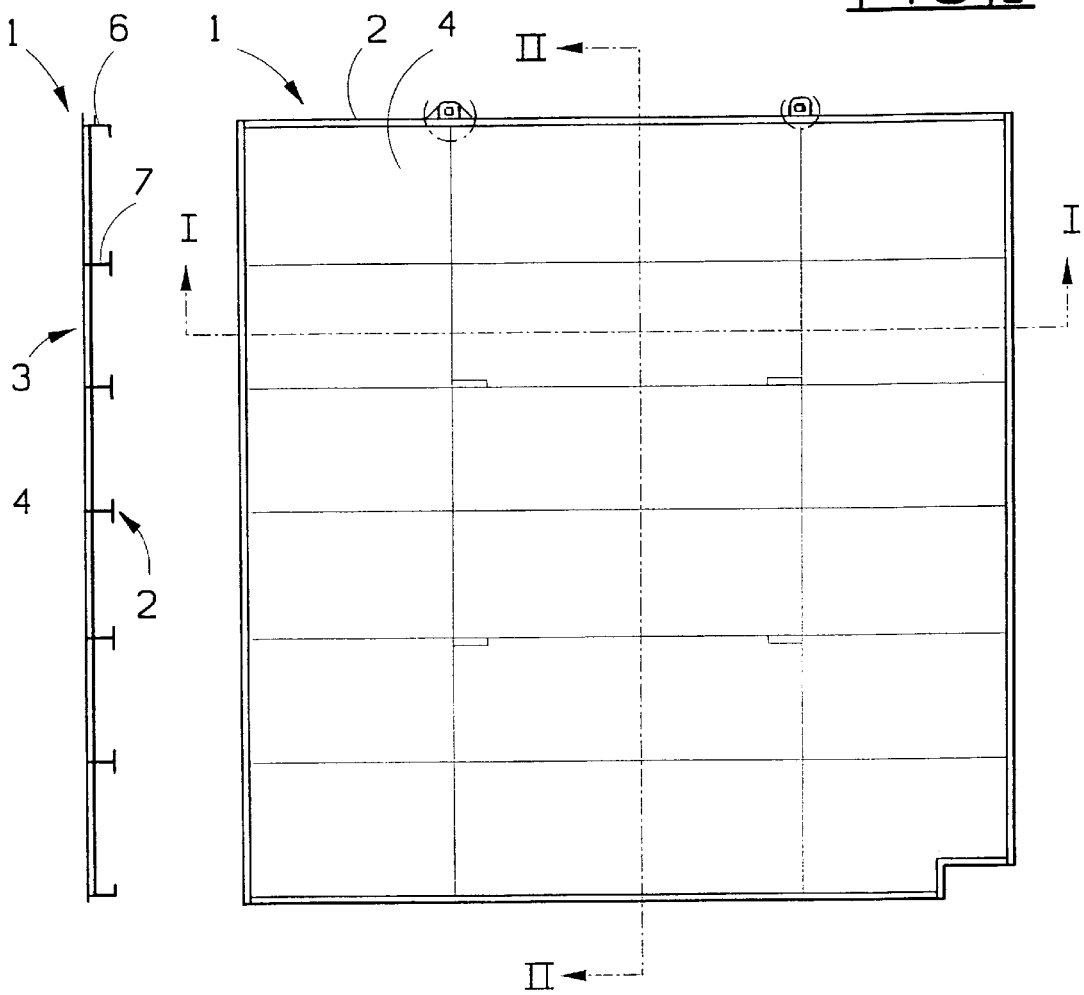
FIG.3
FIG.2

DESIGN ELEMENT FOR BUILDING STRUCTURES

TECHNICAL FIELD

The invention relates to a structural element for building structures comprising a frame structure and an outer plane. The outer plane is constituted by a plurality of plate-formed sandwich elements. The structural element of the present type can be used for example as a movable or fixed vehicle deck on ships.

BACKGROUND TO THE INVENTION

Structural elements such as ships' decks, loading hatches and the like are traditionally made up of steel beams and arrays of plates. The steel beams are part of a more or less complete frame structure comprising, amongst other things, reinforcements for preventing buckling in said plate arrays. Such constructions are used nowadays for instance as movable vehicle decks in Ro-Ro ships. Since these movable vehicle decks are intended to be lowered down from an elevated, stowed position below an overlying deck, attempts are made to make the deck as light as possible. The desired load capacity for modern Ro-Ro ships is ever increasing, which often means more fixed and movable vehicle decks on board new ships. This increases the requirement for weight savings in the ship. Today's traditionally constructed vehicle decks are however already almost as light as possible when taking account of their structural limitations.

PRIOR ART

EP-A-0 074 732 discloses a structural element for building structures, having panels which merely are cover panels which have merely a two-dimensional connection to the beams of the framework. Their contribution to the overall strength of the structural element is very poor.

OBJECT OF THE INVENTION

The object of the present invention is to solve the aforementioned problems by providing a structural element for use, for example, as a movable vehicle deck, which offers an appreciable weight saving with respect to known devices and at the same time leaves the strength of the structural element unaffected.

SOLUTION

The above-mentioned object is achieved in the present invention by providing a structural element for building structures which is characterized in that said sandwich element comprises a core positioned between two cover plates, that said core consisting of a framework structure, that said sandwich elements serve as flanges for beams with conventional webs which are included in the structural element and that the sandwich elements are directly connected with the webs of the beams, whereby the sandwich elements are connected with said frame structure in such a way that they integrally contribute to the overall strength of the structural element.

Said sandwich elements preferably comprise a core positioned between two cover plates, said core consisting of a pyramidal framework structure. It should be mentioned however that the sandwich element can also be constructed in many other different ways. The core can also present for example a corrugated board structure or a honeycomb pattern.

As a result of the invention, a weight saving of up to 30% can be achieved when compared to traditionally built structural elements. This allows, for example, new Ro-Ro ships to be able to be built with notably increased load capacity without a resultant reduction in the ship's stability.

BRIEF DESCRIPTION OF THE DRAWINGS

The invention will now be described in more detail with reference to the accompanying drawings, in which:

FIG. 1 shows a cross-sectional view through a structural element according to the invention, FIG. 2 shows a plan view of the structural element depicted in FIG. 1, FIG. 3 shows a cross-sectional view taken along line II—II in FIG. 2.

DETAILED DESCRIPTION OF PREFERRED EMBODIMENTS

Figure 4:
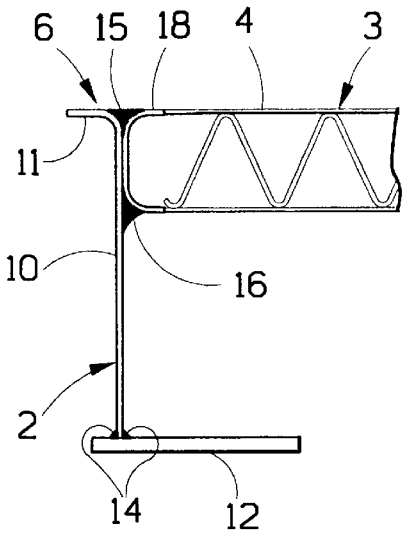
FIG. 4 shows a partial cross-sectional view of an end-beam structure which is included in the structural element according to the invention.

Reference numeral 1 in FIG. 1 generally denotes a structural element in accordance with the invention. In the depicted embodiment, the structural element 1 is used as a movable vehicle deck in a Ro-Ro ship. It should be remembered however that the structural element 1 is also suitable for use as a floor, other types of ships' decks, ships' bulkheads, loading ramps, loading hatches or similar applications where high strength and low weight are sought.

The structural element 1 comprises a frame structure 2 and a support plane 3. The support plane 3 is constituted in accordance with the invention by a plurality of plate-like sandwich elements 4 which are connected with said frame structure 2 in such a way that they integrally contribute to the overall strength of the structural element 1.

FIG. 2 shows the structural element 1 from above. From here it is clear that the structural element 1 in the shown embodiment comprises twenty-four sandwich element pieces. The shown structural element 1 constitutes a part of a movable vehicle deck in a Ro-Ro ship. The cross-section which is shown in FIG. 1 is, more precisely, a cross-sectional view along line I—I in FIG. 2. The size of the included sandwich elements 4 is advantageously adapted for transport in standardised load units such as load containers for land and sea transport. This allows efficient transport of prefabricated sandwich elements from sub-suppliers to the building docks. This is of importance, none the least since the transport distance is often appreciable.

FIG. 3 shows the appearance of the structural element 1 in a cross-sectional view along line II—II in FIG. 2. From here it can be seen that the frame structure 2 comprises end-beam structures 6 and intermediate beam structures 7 respectively. These are also clearly shown in FIG. 1.

FIG. 4 shows an enlarged, partial representation of the end-beam structure 6 which is shown in FIG. 1. The sandwich element 4 serves here as a flange in a beam (in this case the end-beam structure 6) which presents a conventional web 10, an upper end flange 11 as well as a lower flange 12. The web 10 and the flanges 11 and 12 respectively are constructed in a conventional manner, i.e. by simple plates welded together. The end-beam structure 6 is hereby joined with the aid of the welds 14, 15 and 16.

Figure 5:
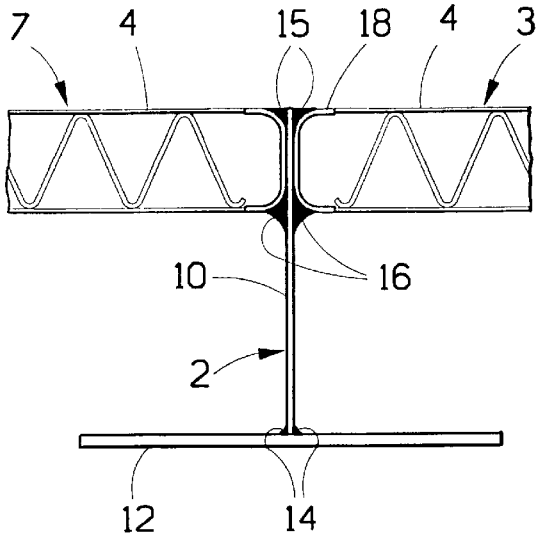
FIG. 5 shows a partial cross-sectional view of a typical intermediate-beam structure according to the invention.

In a corresponding manner, FIG. 5 shows a typical intermediate-beam structure 7 included in the structural element 1. As is clear form the figure, the intermediate-beam structure 7 comprises two sandwich elements 4 which serve as the upper flange for the beam constituted by the intermediate-beam structure 7. Similarly to the end-beam structure 6, the intermediate-beam structure 7 presents a conventional web 10 as well as a conventional lower flange 12. The intermediate-beam structure 7 is joined by means of welds 14, 15 and 16 respectively. In the FIGS. 4 and 5 it is also clear that the sandwich elements 4 present edge portions 18 which are constituted by U-shaped beams. The open sides of the U-shaped beams face inwardly towards the rest of the sandwich element 4. The web 10 advantageously extends inbetween the two U-shaped beams, up to the weld 15 which joins the web and the U-shaped beams together, i.e. to the support plane 3. The construction of the sandwich element 4 will be described in more detail with reference to FIG. 8 onwards.

Figure 6:
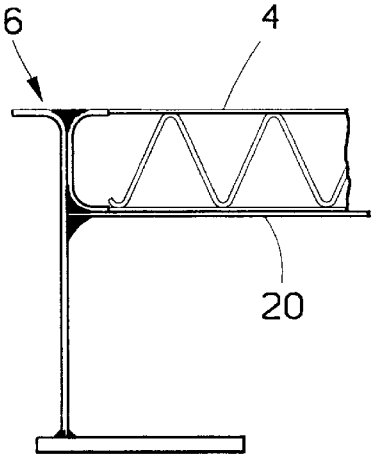
FIG. 6 shows a partial cross-sectional view of another embodiment of an end-beam structure according to the invention.
Figure 7:
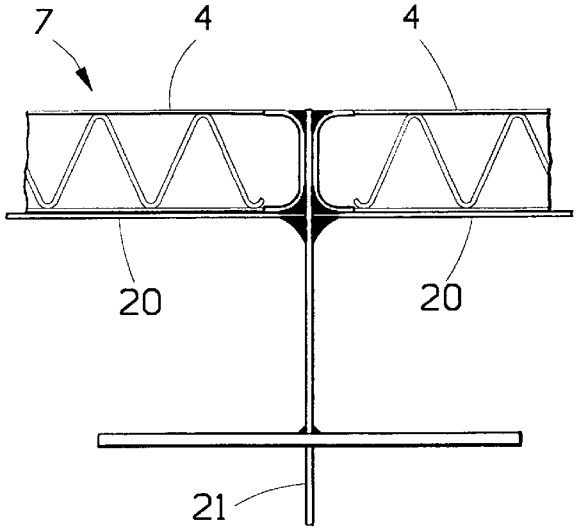
FIG. 7 shows a partial cross-sectional view of a further embodiment of an intermediate-beam structure according to the invention.

Alternative embodiments of the end-beam structure 6 and the intermediate-beam structure are shown in FIGS. 6 and 7. FIG. 6 differs from the embodiment in FIG. 4 in that a horizontal support plate 20 is placed beneath the sandwich element 4. The other components are identical to the components in FIG. 4. Similarly, in FIG. 7, horizontal support plates 20 are placed beneath the sandwich elements 4. In this embodiment, the intermediate-beam structure is additionally provided with a vertical flange 21 for increased strength. In other respects the components in FIG. 7 correspond to those in FIG. 5.

The thickness of the sandwich element 4 constitutes a maximum of 30% of the total thickness of the structural element 1. In the most preferred embodiment, the thickness of the sandwich element 4 constitutes about 15% of said total thickness.

Figure 8:
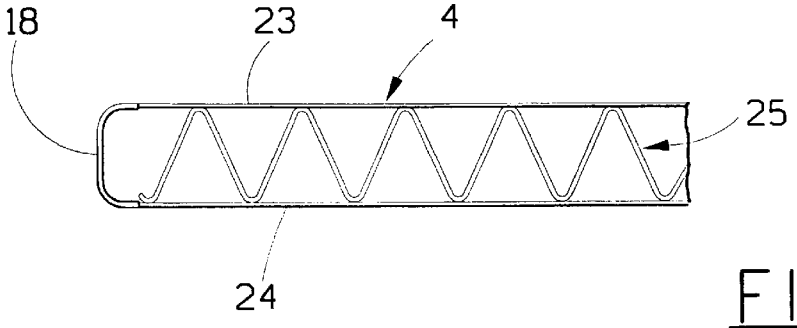
FIG. 8 shows an enlarged, partial cross-sectional view of a sandwich element according to the invention.
Figure 9:
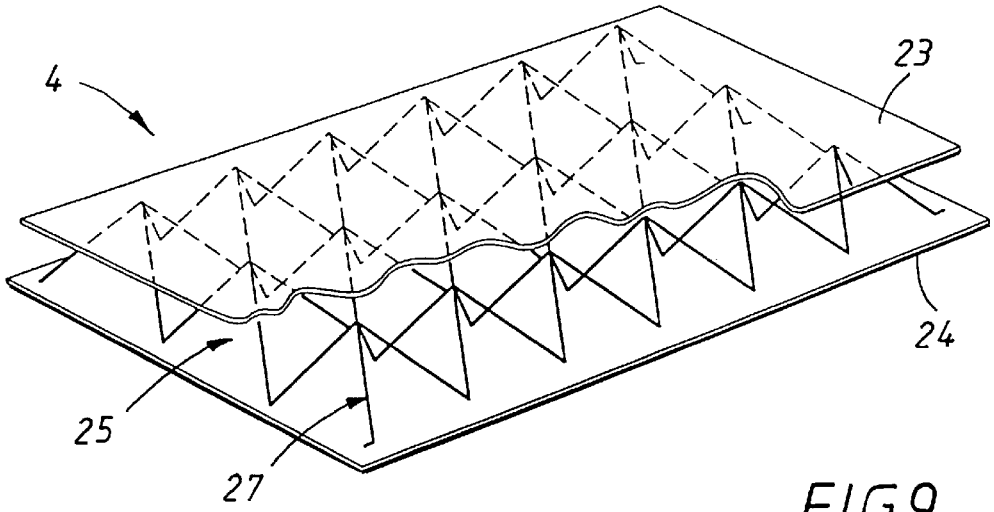
FIG. 9 shows a partial perspective view of the construction of a sandwich element according to the invention.
Figure 10:
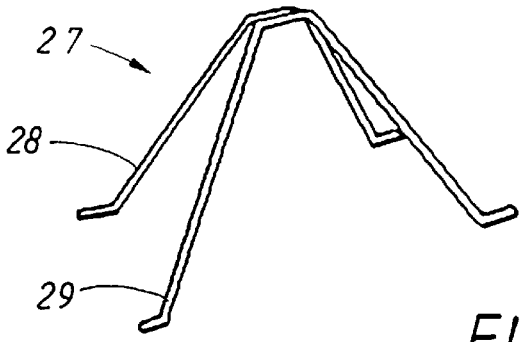
FIG. 10 shows an enlarged perspective view of a bar-pyramid of the type which is included in the core of the sandwich element shown in FIG. 9, and FIG. 11 finally shows a perspective view of an alternative sandwich element according to the invention.
Figure 11:
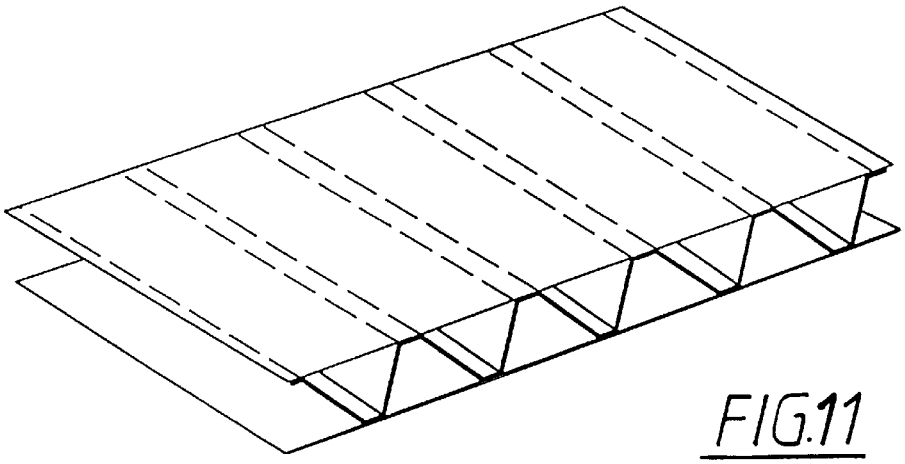

FIG. 8 shows an enlarged partial cross-section of a preferred sandwich element 4 according to the invention. Parts of this sandwich element 4 are also shown in FIGS. 9 and 10. As is clear from the figures, the sandwich element comprises a core 25 positioned between two cover plates 23, 24, said core 25 consisting of a pyramidal framework structure. The separate pyramid structure can be clearly seen in FIGS. 9 and 10, the pyramid structure here being denoted by reference numeral 27. The pyramid structure 27 is in turn constructed from two V-shaped bent bars 28 and 29 respectively as depicted in FIG. 10. The above-described sandwich element 4 is suitably a so-called "PTC"-panel (Pyramidal Truss Core panel), which is manufactured and marketed by the Jonathan Corporation in the USA. The high durability characteristics of the PTC panel make it particularly suitable for use as the sandwich element 4 in the structural element 1 according to the invention. It should however be noted that the invention is not limited to a sandwich element 4 comprising a pyramidal framework structure. The core 25 can instead present a so-called corrugated-board structure for example, as shown in FIG. 11. A further alternative is that the core 25 presents a so-called honeycomb pattern with a plurality of connected polygons (not shown).

A structural element 1 according to the invention is appreciably lighter than a corresponding element constructed in a conventional manner with simple steel beams and plate arrays. This is demonstrated well by the fact that a corresponding conventionally constructed structural element 1 has a surface weight of about 110 kg/m2 which should be compared with a substantially lower surface weight of between 72–73 kg/m2 for a structural element 1 according to the invention. This large weight saving is clearly advantageous for the building of new Ro-Ro ships with a requirement for increased load capacity. By using a structural element in accordance with the invention, an additional vehicle deck can be added without the stability of the ship being affected appreciably.

The present invention is not limited to the embodiments described above and depicted in the drawings, but can be varied freely within the scope of the appended claims. Thus, the structural element 1 according to the invention is equally suitable for use in floors, other types of ships' decks, ships' bulkheads, loading ramps, loading hatches or similar structures. Additionally, other building structures may be envisaged such as chimneys, house buildings etc.

What is claimed is:

1. A structural element, comprising a plurality of webs and a plurality of plate-formed sandwich elements including a top cover plate, a bottom cover plate and a core having a framework structure disposed between said top and bottom cover plates, said sandwich elements being directly connected to said plurality of webs, said webs extending from a point below said bottom cover plate to a point above said bottom cover plate, so that said sandwich elements and said webs serve as beams in said structural element, and so that said sandwich elements serve as flanges and integrally contribute to the overall strength of said structural element.

2. The structural element of claim 1, wherein said sandwich elements include a central portion bounded by a plurality of edge portions, said edge portions comprising U-shaped beams having a pair of ends, said U-shaped beams being disposed so that said pair of ends face inwardly towards said central portion.

3. The structural element of claim 1, wherein said structural element has a first thickness and said sandwich element has a second thickness, said second thickness constituting a maximum of about 30% of said first thickness.

4. The structural element of claim 3, wherein said second thickness constitutes about 15% of said first thickness.

5. The structural element of claim 1, further comprising a support plate for said bottom cover plate.

6. The structural element of any one of claims 1–5, wherein said structural element forms an element selected from the group consisting of a ship deck, ship bulkhead, ship loading ramp, shore mounted loading ramp, ship elevator, ship door, and a loading hatch.

7. A structural element, comprising a plurality of webs and a plurality of plate-formed sandwich elements including a top cover plate, a bottom cover plate and a core having a framework structure disposed between said top and bottom cover plates, said sandwich elements being directly connected to said plurality of webs, said webs extending from a point below said bottom cover plate to said top cover plate so that said sandwich elements and said webs serve as beams in said structural element, and so that said sandwich elements serve as flanges and integrally contribute to the overall strength of said structural element.

8. The structural element of claim 7, further comprising a support plate for said bottom cover plate.

9. The structural element of claim 7, wherein said sandwich elements include a central portion bounded by a plurality of edge portions, said edge portions comprising U-shaped beams having a pair of ends, said U-shaped beams being disposed so that said pair of ends face inwardly towards said central portion.

10. The structural element of claim 7, wherein said structural element has a first thickness and said sandwich element has a second thickness, said second thickness constituting a maximum of about 30% of said first thickness.

11. The structural element of claim 10, wherein said second thickness constitutes about 15% of said first thickness.

12. The structural element of any one of claims 7–11, wherein said structural element forms an element selected from the group consisting of a ship deck, ship bulkhead, ship loading ramp, shore mounted loading ramp, ship elevator, ship door, and a loading hatch.

* * * * *

UNITED STATES PATENT AND TRADEMARK OFFICE

CERTIFICATE OF CORRECTION

PATENT NO. : 6,212,839 B1
DATED : April 10, 2001
INVENTOR(S) : Carlberg

It is certified that error appears in the above-identified patent and that said Letters Patent is hereby corrected as shown below:

Title page,
Item [73], "Macgregor" should read -- MacGregor --

Signed and Sealed this

Twelfth Day of February, 2002

*Attest:*

*Attesting Officer*

JAMES E. ROGAN
*Director of the United States Patent and Trademark Office*